US010048015B1

(12) United States Patent
Lin

(10) Patent No.: US 10,048,015 B1
(45) Date of Patent: Aug. 14, 2018

(54) LIQUID-VAPOR SEPARATING TYPE HEAT CONDUCTIVE STRUCTURE

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 0 days.

(21) Appl. No.: 15/603,463

(22) Filed: May 24, 2017

(51) Int. Cl.

| | |
|---|---|
| ***F28D 15/00*** | (2006.01) |
| ***F28D 15/04*** | (2006.01) |
| ***F28F 9/22*** | (2006.01) |
| ***F28D 15/02*** | (2006.01) |
| *F28D 21/00* | (2006.01) |

(52) U.S. Cl.
CPC ..... *F28D 15/04* (2013.01); *F28D 15/0266* (2013.01); *F28D 15/046* (2013.01); *F28F 9/22* (2013.01); *F28D 2021/0028* (2013.01)

(58) Field of Classification Search
CPC ..... F28D 15/0275; F28D 15/04; F28D 15/046
USPC ..... 165/104.26, 104.33; 29/890.032
See application file for complete search history.

(56) References Cited

U.S. PATENT DOCUMENTS 4,441,548 A * 4/1984 Franklin ..... F28D 15/046 165/104.26
7,520,315 B2 * 4/2009 Hou ..... F28D 15/0233 165/104.26
7,594,537 B2 * 9/2009 Hou ..... F28D 15/0233 165/104.26
7,891,413 B2 * 2/2011 Liu ..... F28D 15/046 165/104.21
2007/0235165 A1 * 10/2007 Liu ..... F28D 15/046 165/104.26
2009/0260790 A1 * 10/2009 Wang ..... B23P 15/26 165/177
2014/0138059 A1 * 5/2014 Ambrose ..... B64G 1/503 165/104.26
2016/0187069 A1 * 6/2016 Sun ..... F28D 15/043 165/104.26
2017/0153064 A1 * 6/2017 Lan ..... F28D 15/046

* cited by examiner

*Primary Examiner* — Len Tran
*Assistant Examiner* — Paul Alvare
(74) *Attorney, Agent, or Firm* — Chun-Ming Shih; HDLS IPR Services

(57) ABSTRACT

A liquid-vapor separating type heat conductive structure includes a vapor chamber, a heat pipe, a separation plate, and a working fluid. The vapor chamber includes a housing and a cavity. The housing includes a bottom plate and an upright plate. A first capillary structure is disposed on an inner surface of the bottom plate, and a through hole is formed on the upright plate. The heat pipe includes a pipe body and a second capillary structure. The pipe body includes an open end, the open end of the pipe body is inserted and sealingly connected to the through hole. The separation plate is disposed at the open end and covers the first capillary structure and the second capillary structure, so as to form a vapor passage and a liquid passage at two sides of the separation plate respectively. The working fluid is filled inside the cavity.

7 Claims, 5 Drawing Sheets

LIQUID-VAPOR SEPARATING TYPE HEAT CONDUCTIVE STRUCTURE

TECHNICAL FIELD

The present invention relates to a heat conductive technique and, in particular, to a liquid-vapor separating type heat conductive structure.

BACKGROUND

With the increasing of computer processing speed, electronic components generate much more heat than before. In order to dissipate heat effectively, heat pipes and vapor chambers are used extensively. Although, the heat pipe allows a working fluid in vapor phase inside the heat pipe to flow along substantially the same direction, the heat pipe can dissipate very limited heat due to the small size itself. On the other hand, although the vapor chamber has a wide heated area which is attached to a heat source directly to transfer heat therefrom, the vapor-phase working fluid flows in different/chaotic directions, so a heat dissipation capability is very limited.

To solve the above-mentioned problems, the heat pipe and the vapor chamber are connected together to form a heat conductive structure, wherein the heat pipe is inserted and connected to one lateral side of the vapor chamber and the heat pipe is in communication with an inner space of the vapor chamber.

However, although the conventional structure of the vapor chamber combined with the heat pipe can transfer and dissipate heat, it has the disadvantage that, when the vapor-phase working fluid flows into the heat pipe, a flow speed increases because a cross-sectional area becomes smaller, and as a result, flowing back of the liquid-phase working fluid is interfered by the increased flow speed, and therefore the liquid-phase working fluid, while attempting to flow back, goes back to one end of the heat pipe away from the vapor chamber. This leads to problems like the vapor chamber being heated without there being any liquid inside, which is not desired and should be avoided. Furthermore, a capillary structure inside the heat pipe is not in contact with a capillary structure inside the vapor chamber, leading to an interrupted or discontinuous flow of the liquid-phase working fluid while it is flowing back, and as a result, heat dissipation efficiency is considerably reduced.

SUMMARY

It is an object of the present invention to provide a liquid-vapor separating type heat conductive structure, wherein a separation plate is used for separation into a vapor passage and a liquid passage. Therefore, when flowing back, a working fluid in liquid phase is not affected by the working fluid in vapor phase, and thereby a flow speed of the working fluid is boosted.

Accordingly, the present invention provides a liquid-vapor separating type heat conductive structure. The liquid-vapor separating type heat conductive structure includes a vapor chamber, a heat pipe, a separation plate, and a working fluid. The vapor chamber includes a housing and a cavity formed inside the housing. The housing includes a bottom plate and an upright plate extending from the bottom plate, a first capillary structure is disposed on an inner surface of the bottom plate, and a through hole communicating with the cavity is formed on the upright plate. The heat pipe includes a pipe body and a second capillary structure disposed inside the pipe body, the pipe body includes an open end, and the open end of the pipe body is inserted and sealingly connected to the through hole. The separation plate is disposed at the open end and covers the first capillary structure and the second capillary structure, so that a vapor passage and a liquid passage are formed at two sides of the separation plate respectively. The working fluid is filled inside the cavity.

The present invention further has the following effects. By the first capillary structure being in contact with the second capillary structure, a flow speed of the liquid-phase working fluid flowing back is increased. By an elongated covering plate being connected to each curved plate, the liquid-phase working fluid flowing back from each heat pipe can achieve interchange of the working fluid or get a supply of the working fluid.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
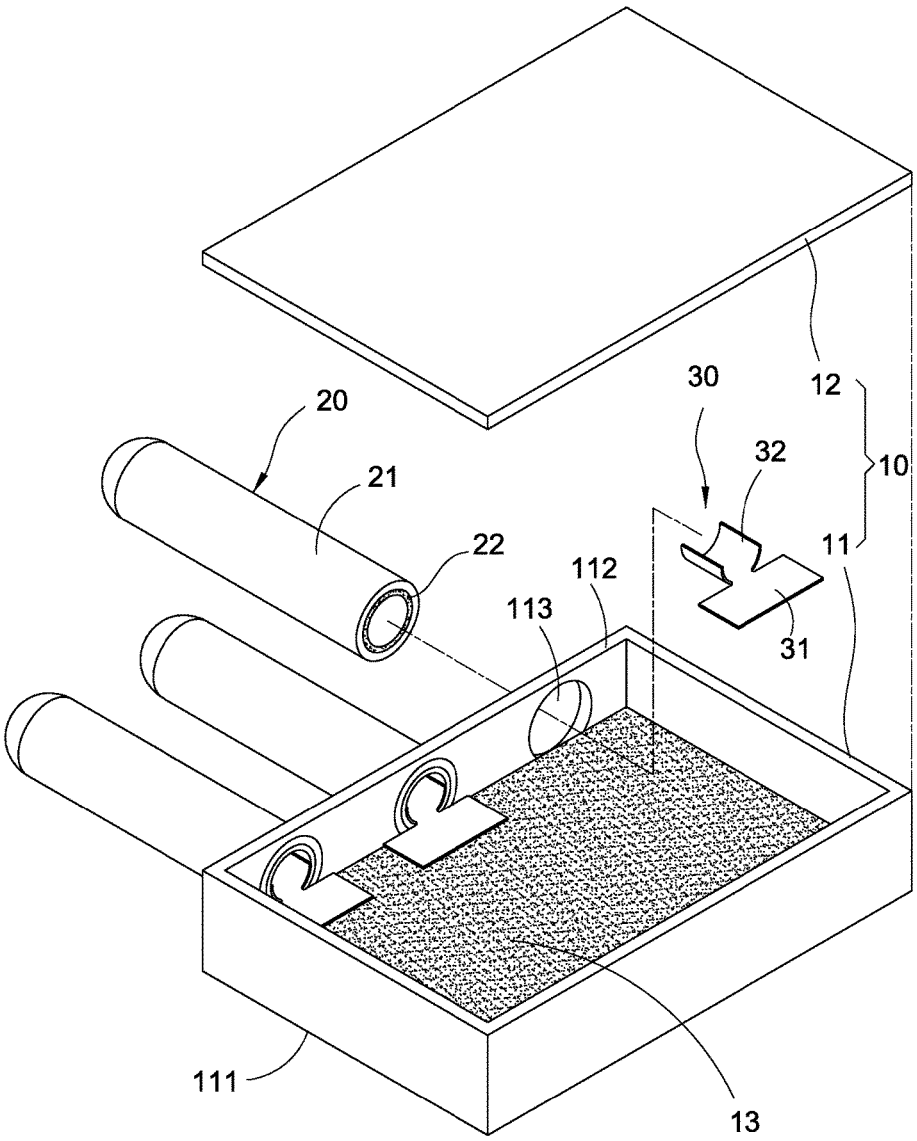
FIG. 1 is a perspective exploded view showing the present invention.
Figure 2:
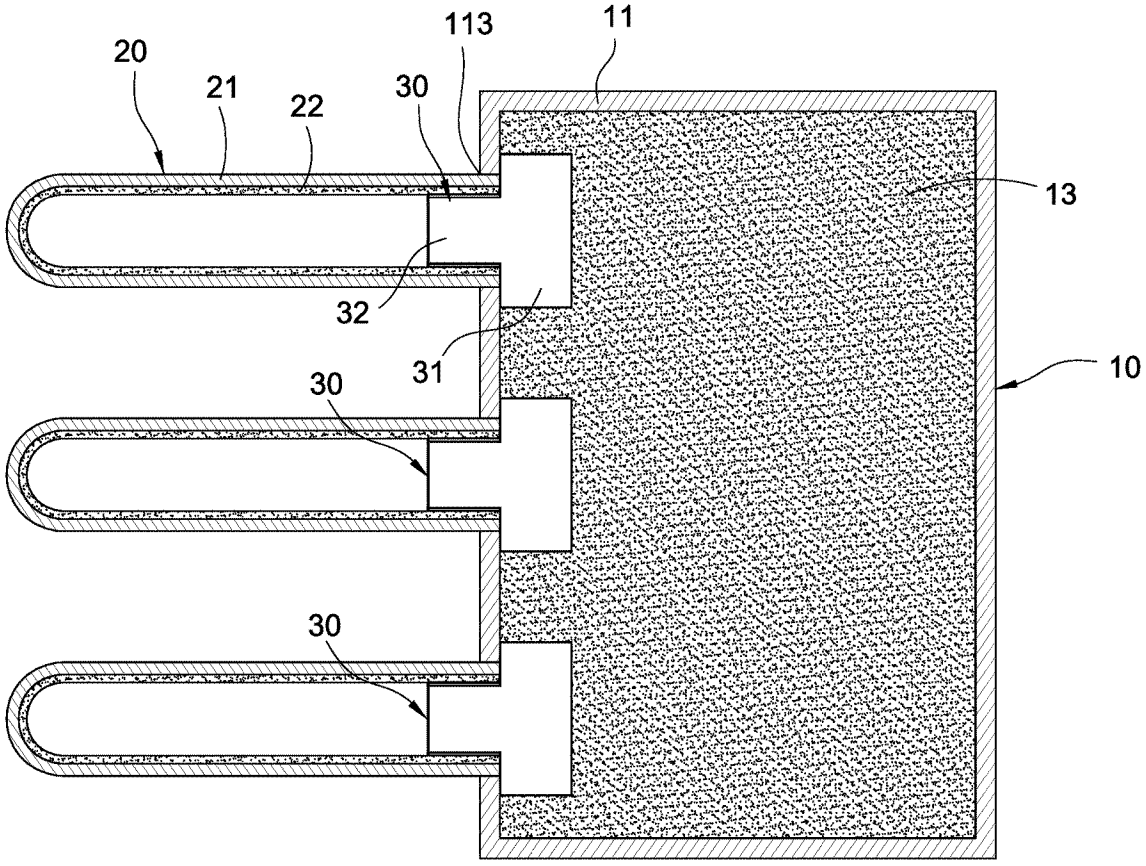
FIG. 2 is a cross-sectional view showing the present invention.
Figure 3:
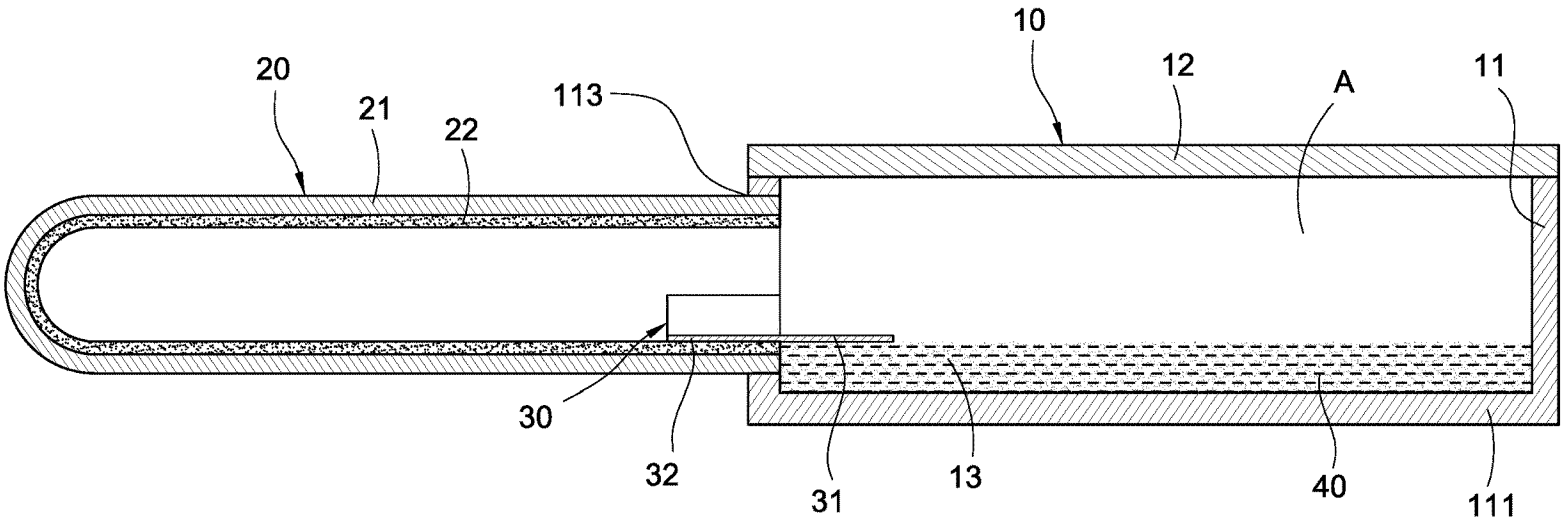
FIG. 3 is a cross-sectional view taken in another direction showing the present invention.

Referring to FIGS. 1 and 3, the present invention provides a liquid-vapor separating type heat conductive structure which includes a vapor chamber 10, a heat pipe 20, a separation plate 30, and a working fluid 40.

In the present embodiment, the vapor chamber 10 includes a housing having a lower housing part 11 and an upper housing part 12. The upper housing part 12 and the lower housing part 11 consist of a high thermal conductivity material like copper, aluminum, or alloy thereof. The lower housing part 11 includes a bottom plate 111 of rectangular shape and an upright plate 112 extending upwardly from the rectangular bottom plate 111. The upper housing part 12 is connected to the lower housing part 11 to close and seal the same, so as to form a cavity A between the upper housing part 12 and the lower housing part 11. A through hole 113 communicating with the cavity A is formed on the upright plate 112. A first capillary structure 13 is disposed on an inner surface of the bottom plate 111. The first capillary structure 13 consists of a metal web, a fiber bundle or sintered metal powder. Similarly, the first capillary structure 13 can also be disposed on an inner surface of the upright plate 112 and on an inner surface of the upper housing part 12.

The heat pipe 20 includes a pipe body 21 and a second capillary structure 22. The pipe body 21 consists of a high thermal conductivity material like copper, aluminum, or alloy thereof. The pipe body 21 includes a closed end and an open end, and the second capillary structure 22 consists of a metal web, a fiber bundle or sintered metal powder. The second capillary structure 22 is disposed on an inner surface of the pipe body 21 and extends to an end face of the open end of the pipe body 21, the open end of the heat pipe 20 is inserted and sealingly connected to the through hole 113, and an end face of the second capillary structure 22 is in contact with the first capillary structure 13.

The separation plate 30 is a gas-impermeable plate consisting of a copper foil sheet, an aluminum foil sheet or alloy thereof. The separation plate 30 includes a covering plate 31 and a curved plate 32 connected to the covering plate 31, the covering plate 31 is substantially of rectangular shape and is disposed on an inner surface of the first capillary structure 13 to cover the same, and the curved plate 32 has a radius of curvature equal to a radius of curvature of an inner surface of the second capillary structure 32, so that the curved plate 32 is in close contact with the second capillary structure 22 while covering the same, and consequently, a vapor passage C1 is formed above the separation plate 30 and a liquid passage C2 is formed under the separation plate 30.

The working fluid 40 can be water. Through a gas-removal liquid inlet pipe (not illustrated) communicating with the cavity A, the working fluid 40 is filled into the cavity A formed between the upper housing part 12 and the lower housing part 11. Gases are removed from the working fluid 40 by means of the gas-removal liquid inlet pipe, and the gas-removal liquid inlet pipe is then closed and sealed to form the liquid-vapor separating type heat conductive structure.

Figure 4:
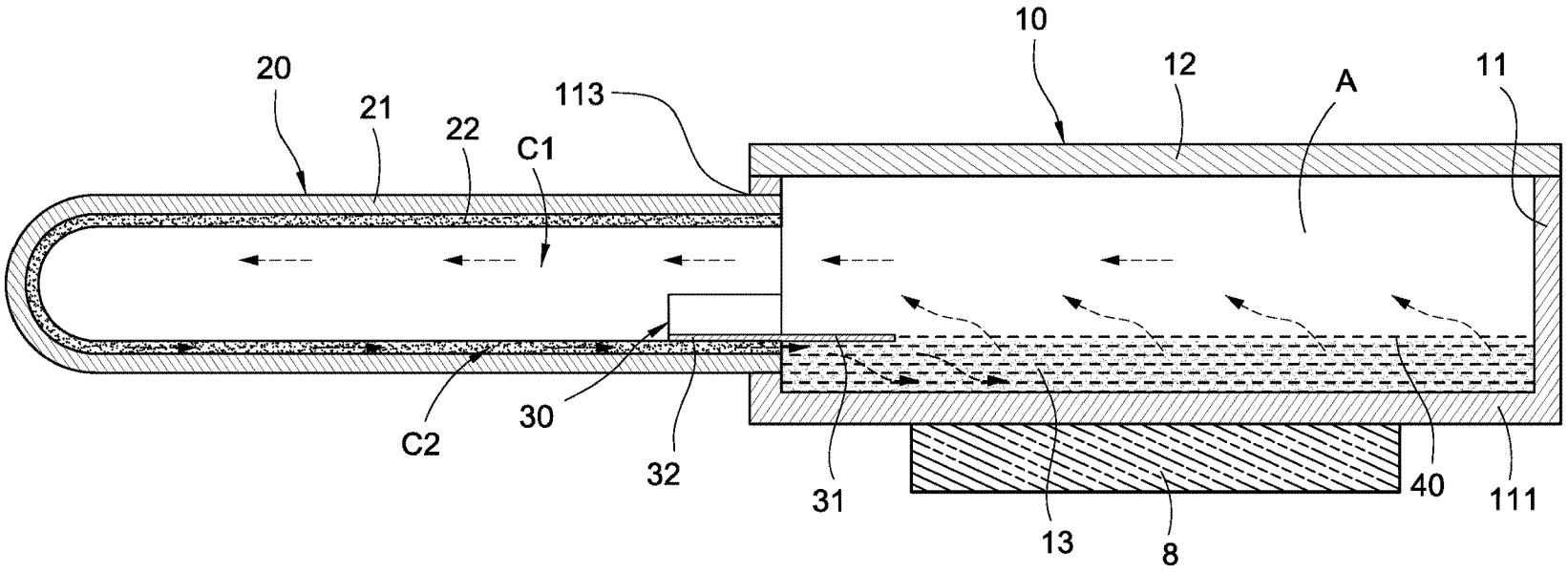
FIG. 4 is a cross-sectional view showing the present invention used on a heat source.

Referring to FIG. 4, the bottom plate 111 of the vapor chamber 10 is closely attached to a heat source 8. When the heat source 8 generates a lot of heat, the working fluid 40 in liquid phase in the first capillary structure 13 is evaporated by the heat and is converted into the working fluid 40 in vapor phase. The vapor-phase working fluid 40 with a large amount of heat flows to the inside of the pipe body 21 of the heat pipe 20 passing the vapor passage C1, and when reaching one end of the heat pipe 20 away from the vapor chamber 10, the vapor-phase working fluid 40, by means of heat dissipating elements (not illustrated) such as heat dissipating fins, is cooled and condensed into the working fluid 40 in liquid phase. The liquid-phase working fluid 40 flows back to the first capillary structure 13 through the liquid passage C2 by means of a capillary phenomenon in the second capillary structure 22 and by means of the second capillary structure 22 being in contact with the first capillary structure 13. As a result, continuous circulation is carried on to carry away and dissipate heat.

The working fluid 40 in vapor phase and the working fluid 40 in liquid phase flow along different paths separated by the separation plate 30. Therefore, although the vapor-phase working fluid 40 flows faster when flowing past the open end due to the open end having a smaller cross-sectional area, the increased flow speed of the vapor-phase working fluid 40 does not interfere flowing back of the liquid-phase working fluid 40, so a flow speed of the liquid-phase working fluid 40 is increased.

Figure 5:
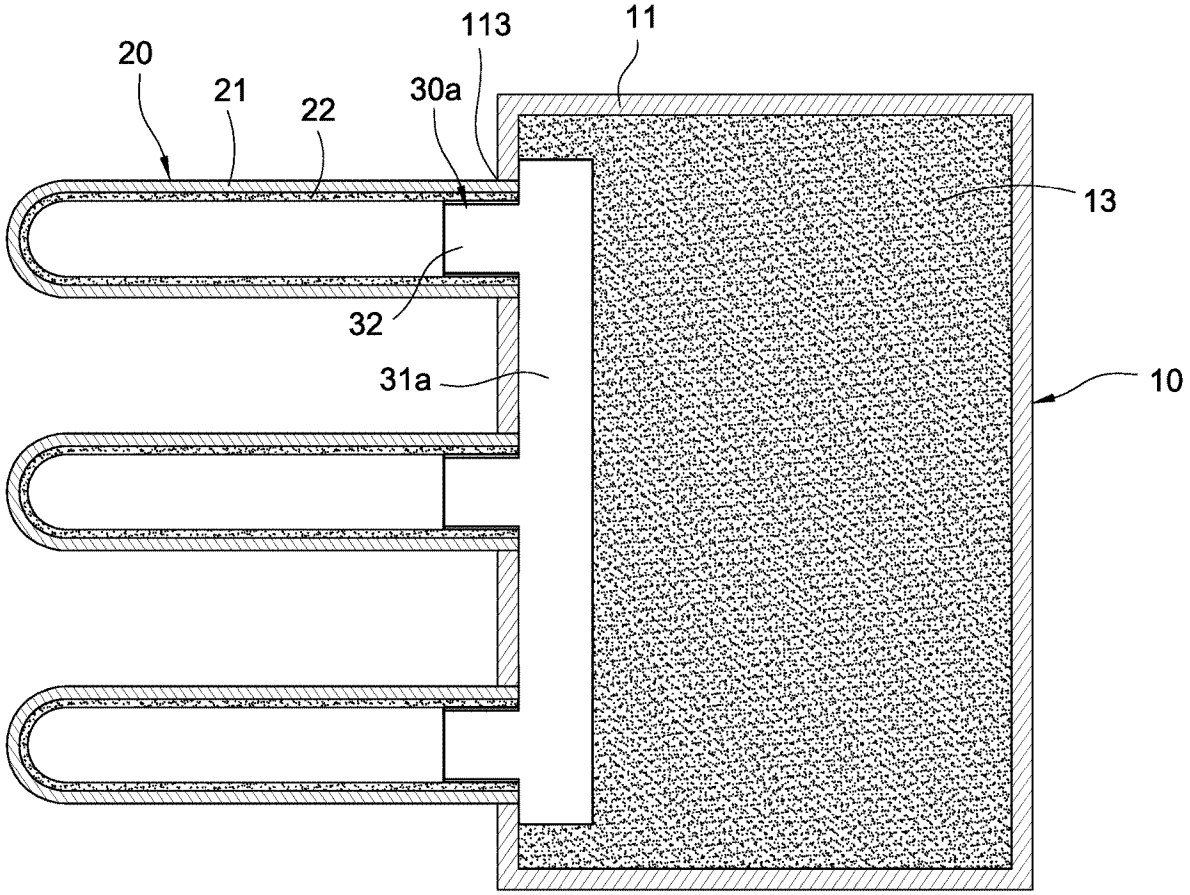
FIG. 5 is a cross-sectional view showing the present invention according to another embodiment.

Referring to FIG. 5 showing another embodiment of the present invention, this embodiment is different from the previous embodiment in that, a separation plate 30*a* includes an elongated covering plate 31*a* and multiple curved plates 32, each curved plate 32 is inserted and connected to each heat pipe 20 to cover each second capillary structure 22, the elongated covering plate 31*a* extends across each open end of the heat pipes 20 to cover the first capillary structure 13, so the liquid-phase working fluid 40 flowing back from each heat pipe 20 can achieve interchange of the working fluid 40 or get a supply of the working fluid 40.

In summary, the liquid-vapor separating type heat conductive structure certainly can achieve anticipated objectives and solve the conventional defects. The present invention also has novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. A liquid-vapor separating type heat conductive structure, comprising:

a vapor chamber, the vapor chamber including a housing and a cavity formed inside the housing, the housing including a bottom plate and an upright plate extending from the bottom plate, a first capillary structure being disposed on an inner surface of the bottom plate, a through hole communicating with the cavity being formed on the upright plate;

a heat pipe, the heat pipe including a pipe body and a second capillary structure disposed inside the pipe body, the pipe body including an open end, the open end of the pipe body being inserted and sealingly connected to the through hole;

a separation plate, the separation plate being disposed at the open end and covering the first capillary structure and the second capillary structure, so that a vapor passage and a liquid passage are formed at two sides of the separation plate respectively; and a working fluid filled inside the cavity, wherein the liquid-vapor separating type heat conductive structure includes multiple heat pipes, each of the heat pipes is inserted and connected to the vapor chamber, the separation plate includes an elongated covering plate and multiple curved plates connected to the elongated covering plate, the elongated covering plate is disposed on an inner surface of the first capillary structure, and each of the curved plates is disposed on the second capillary structure of each of the corresponding heat pipes.

2. The liquid-vapor separating type heat conductive structure according to claim 1, wherein the separation plate is a gas-impermeable plate.

3. The liquid-vapor separating type heat conductive structure according to claim 2, wherein the separation plate is a copper foil sheet or an aluminum foil sheet.

4. The liquid-vapor separating type heat conductive structure according to claim 1, wherein the curved plates have a radius of curvature equal to a radius of curvature of an inner surface of the second capillary structure.

5. The liquid-vapor separating type heat conductive structure according to claim 1, wherein an end face of the second capillary structure is in contact with the first capillary structure.

6. The liquid-vapor separating type heat conductive structure according to claim 1, wherein the first capillary structure consists of a metal web, a fiber bundle or sintered metal powder.

7. The liquid-vapor separating type heat conductive structure according to claim 1, wherein the second capillary structure consists of a metal web, a fiber bundle or sintered metal powder.

* * * * *